US006059471A

United States Patent [19]

Dobring et al.

[11] Patent Number: 6,059,471

[45] Date of Patent: May 9, 2000

[54] DEVICE FOR CONVEYING A FORM IN A PRINTER

[75] Inventors: Wilfried Dobring; Günter Baitz, both of Berlin, Germany

[73] Assignee: Siemens Nixdorf Informationssysteme AG, Paderborn, Germany

[21] Appl. No.: 09/068,698

[22] PCT Filed: Nov. 6, 1996

[86] PCT No.: PCT/DE96/02117

§ 371 Date: May 13, 1998

§ 102(e) Date: May 13, 1998

[87] PCT Pub. No.: WO97/18086

PCT Pub. Date: May 22, 1997

[30] Foreign Application Priority Data

Nov. 13, 1995 [DE] Germany ..... 195 42 233

[51] Int. Cl.[7] ..... B41J 13/22

[52] U.S. Cl. ..... 400/622; 400/521; 400/536

[58] Field of Search ..... 400/622, 623, 400/543, 523, 536, 539, 521, 524, 525, 120.01, 120.16, 542

[56] References Cited

U.S. PATENT DOCUMENTS 4,812,064 3/1989 Hatakeyama et al. ..... 400/622

5,468,079 11/1995 Murakoshi et al. ..... 400/521

FOREIGN PATENT DOCUMENTS 2-134270 5/1990 Japan ..... 400/622

2-134271 5/1990 Japan ..... 400/622

4-37570 2/1992 Japan ..... 400/622

5-286192 11/1993 Japan ..... 400/622

*Primary Examiner*—Christopher A. Bennett

*Attorney, Agent, or Firm*—Hill & Simpson

[57] ABSTRACT

A device for transporting a sheet (18) to be printed in a printer is described, with a carriage (14) which is designed for receiving the sheet and which can be displaced on a fixed stand (12) perpendicularly to the line direction between a starting position for inserting and removing the sheet and an end position moved into the printer. Mounted on the carriage (14) is a releasable clamping device (26) which comprises a bearing surface (22) for the sheet (18) and a clamping lever (35) spring-loaded in the clamping direction. The latter is provided with an actuating cam (48) which co-operates with a control bar (40) provided on the stand (12), in such a way that the clamping device (26) is opened in the starting position, closes after this starting position has been passed in the direction opposite to the end position and opens again when the carriage (14), coming from the end position, reaches the starting position.

9 Claims, 3 Drawing Sheets

DEVICE FOR CONVEYING A FORM IN A PRINTER

BACKGROUND OF THE INVENTION

1. Field of the Invention

The present invention relates to a device for transporting a sheet to be printed in a printer, with a carriage which is designed for receiving the sheet and which can be displaced on a fixed stand perpendicularly to the line direction between a starting position for inserting and removing the sheet and an end position moved into the printer, with a drive device for the carriage and with a releasable clamping device for clamping the sheet, which clamping device is arranged on the carriage and is provided with means for its own release which are actuated by actuating means coming into engagement with the carriage in the starting position of the latter.

2. Description of the Related Art

Such a device is known from European Patent Document EP 0,080,723 B1. Racks, which engage with toothed segments that can be pivoted using a motor, are provided on the carriage. Provided as a clamping device is a leaf spring, one end of which is fastened to the carriage and the free end of which bears under pre-stress on the carriage. Arranged on the leaf spring is a lift-off pin which projects through a bore, running from the rear side of the rack in the region of the toothing of the latter, into a tooth space and, in the position corresponding to the starting position of the carriage, is displaced by a tooth of the toothed segment with the desired effect of lifting off the leaf spring.

In order to ensure that the clamping device is closed before the carriage is moved into the printer, the pivoting shaft carrying the toothed quadrants is longitudinally displaceable. Before the transport movement of the carriage commences, the pivoting shaft is pushed so far to the side by a cam disk that the lift-off pin is released. The shaft is pushed into its original position again only when the toothed quadrant no longer comes into engagement with the tooth space containing the lift-off pin.

The known device is highly complicated in terms of construction, since several movable control elements have to interact at various points in the device.

SUMMARY OF THE INVENTION

An object of the invention is, therefore, to provide a device of this type, whose device is simple to control.

This and other objects are achieved by (insert claim 1).

The invention proceeds from the notion that it is perfectly possible for the carriage to be moved, with a sheet to be printed and with the clamping device released, when it is transported only in the direction of ejection. The device according to the invention makes use of this knowledge, in that, to close the clamping device, the carriage is moved first in the direction opposite to the end position and thereafter only in the direction of the end position moved into the printer. Since the sheet, due to its weight, rests snugly with its lower edge on the bearing surface, it cannot lift off from the latter during the upward movement and, finally, is grasped in the exact position by the clamping device.

For this purpose, the clamping device comprises a bearing surface for the sheet and a clamping lever which is spring-loaded in the clamping direction and on which an actuating cam is mounted. Furthermore, there is provided on the stand a control bar, on which the actuating cam is guided during the displacement of the carriage, in such a way that, in the starting position of the carriage, the actuating cam bears on a predetermined portion of one side of the control bar, with the result that the clamping device is released. After the starting position has been passed in the direction opposite to the end position, the actuating cam passes the upper edge of the control bar, with the result that the clamping device is closed. During the movement of the carriage in the direction of the end position, the actuating cam slides along on the other side of the control bar as far as the lower end of the latter, after passing the end is shifted in the direction of the one side of the control bar and, during the subsequent movement of the carriage, slides along on said control bar in the direction of the starting position, but the clamping device remains closed until the carriage, coming from the end position, runs onto the predetermined portion of the control bar.

Preferably, the clamping device is a clamp which is formed from two two-armed levers connected rotatably to one another and between the lower clamp arms of which a compression spring is arranged and between the upper clamp arms of which a sheet can be clamped. In this case, the first lever is formed by the clamping lever. The carriage may then be designed in such a way that the clamp comprises an angular contact rail which forms a second lever and the vertical leg of which forms one of the upper clamp arms and the horizontal leg of which is a bearing surface for the sheet, the clamping lever being mounted rotatably on the contact rail.

In a first exemplary embodiment of the invention, the clamping lever is inherently rigid against bending and the actuating cam is arranged on the lower lever arm of the clamping lever. The control bar is a stretched spring, of which the upper part of its side edge, the part being assigned to the predetermined portion, is connected to the stand and the lower part of which points away from the displacement path of the carriage at an acute angle.

On the displacement path of the carriage from its uppermost position to the end position, the actuating cam slides along on that side of the spring which faces away from the clamping device. Since the upper clamp arms of the clamping device already rest against one another, the actuating cam cannot escape from the spring. On the contrary, it flexes the lower part of the latter into an orientation parallel to the displacement path of the carriage. After the actuating cam has passed the lower end of the spring, the latter jumps back into its original shape. When the carriage is then moved again in the direction of the starting position, the actuating cam slides along on the side facing the clamping device, until the actuating cam runs onto the predetermined part of the spring. Since, in this region, the spring is connected at its side edge to the stand and is consequently rigid, the clamping device is released.

The stretched spring may be formed both by a leaf spring and by a spring wire.

In a second exemplary embodiment of the invention, at least that lever arm of the clamping lever on which the actuating cam is arranged is elastically deformable and the control bar is inherently flexurally rigid, connected laterally to the stand and bent in its upper region in the direction of the clamping device.

In this case, on the path of the carriage from the starting position in the direction opposite to the end position, the actuating cam slides along on the bent upper region of the control bar, the elastic part of the clamping lever being deformed in a direction corresponding to the releasing path of the clamping lever, that is to say keeping the clamp open.

When the top edge of the control bar is passed, the lever jumps back into its relaxed shape. On the displacement path of the carriage from its uppermost position to the end position, the actuating cam slides along on that side of the spring which faces away from the clamping device, with the result that the elastic part of the clamping lever is deformed in the direction opposite to the releasing direction. After the actuating cam has passed the lower end of the control bar, the elastic part of the clamping lever jumps back into its original shape. When the carriage is then moved again in the direction of the starting position, the actuating cam slides along on the side facing the clamping device, until the actuating cam runs onto the bent upper region of the control bar. The clamping device is thereby released again.

An exemplary embodiment of the invention is illustrated in the drawing and is described in more detail below.

BRIEF DESCRIPTION OF TH DRAWINGS

FIG. 1 shows a diagrammatic perspective front view of the transport device, in which the carriage is located in its uppermost position, FIG. 2 shows a view of the transport device, in which the carriage is located in its end position, FIGS. 3*a*–3*f* show details of the transport device in sectional side views, the carriage being illustrated in six different positions.

DETAILED DESCRIPTION OF THE INVENTION

Figure 1:
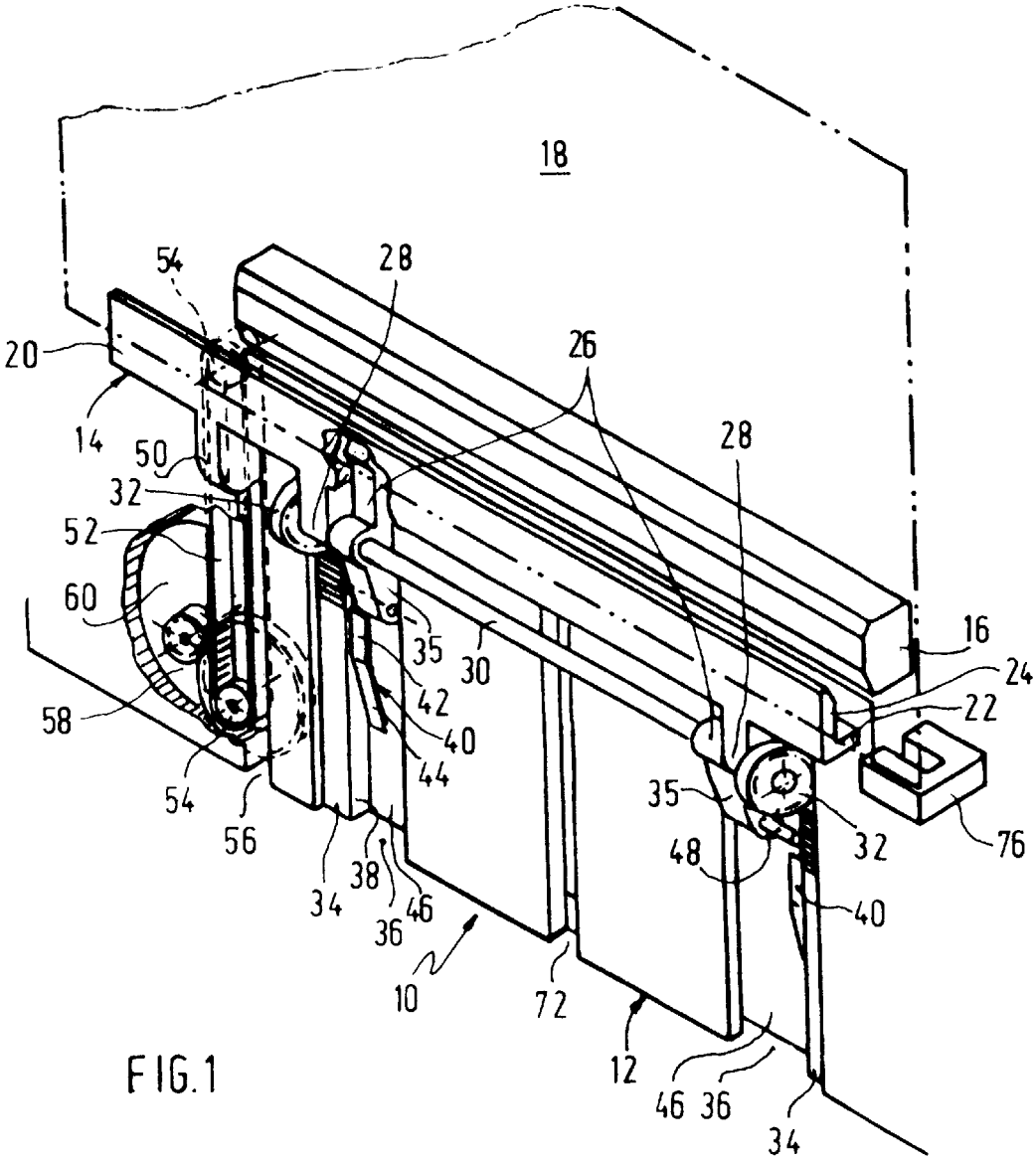

FIG. 1 shows an exemplary embodiment of a transport device 10 according to the invention in a diagrammatic perspective front view. The transport device is composed of a fixed stand 12 which is arranged on a printer and on which a carriage 14 can be moved in the vertical direction. Of the printer, only a pressure beam 16, against which a sheet 18 to be printed leans with its rear side, is illustrated. The sheet 18 can be printed on its front side, for example by means of a matrix printing head not illustrated. However, the transport device 10 may also be used in a printer working according to the ink-jet, thermographic or other method.

Figure 3:
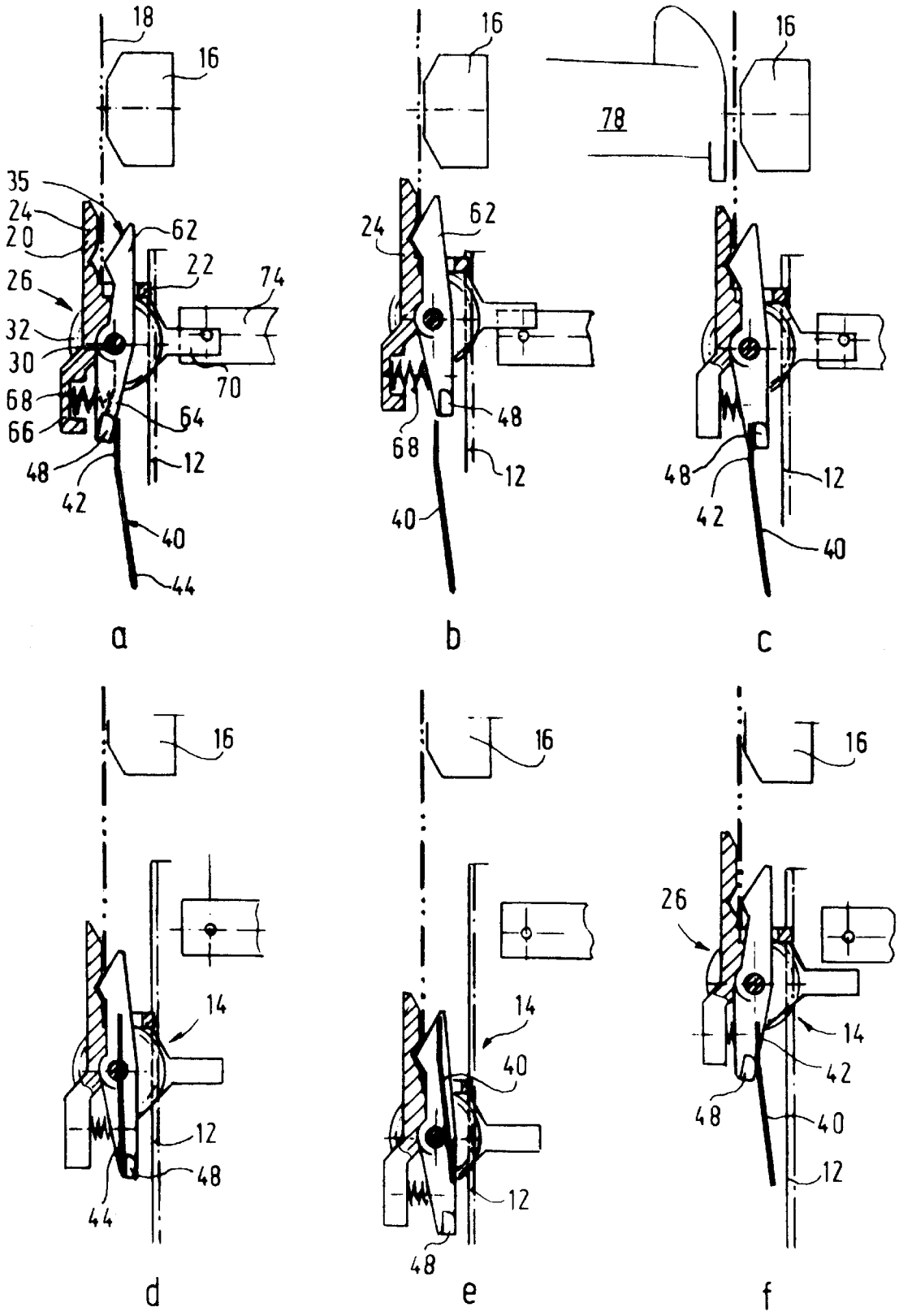

The carriage 14 contains a contact rail 20, angular in cross section, the horizontal leg 22 of which forms a bearing surface for the lower edge of the sheet 18. The vertical leg 24 forms a clamping arm of a clamp-like clamping device 26 which is also described with reference to FIG. 3. In the present exemplary embodiment, two clamping devices 26 are provided, but the number of these is not essential to the invention and depends primarily on the width of the sheets 18 to be transported.

Formed onto the underside of the contact rail 20 are two bearing blocks 28, in which a guide shaft 30 running parallel to the legs 22, and 24 is mounted rotatably. A gearwheel 32 is connected fixedly in terms of rotation to each end of the guide shaft 30. Each gearwheel meshes with a rack 34. Furthermore, two two-armed clamping levers 35 belonging to the clamping devices 26 are mounted pivotably on the guide shaft 30. The clamping levers 35 project partially into grooves 36 which, running parallel to the direction of transport of the carriage 14, are designed on the front side of the stand 12.

A leaf spring 40 is fastened to one side wall 38 of each groove 36. The leaf spring 40 has an upper part 42 which runs parallel to the front side of the stand 12 and one side edge of which is fastened to the side wall 38 of the groove 36. A lower part 44 of the leaf spring 40 has no connection to the stand 12 and is bent obliquely in the direction of the rear wall 46 of the groove 36. The lower part consequently lies freely movably in the groove 36. Fastened to each clamping lever 35 is an actuating cam 48 which stands in a relationship to the leaf spring 40 which is described further below and which controls the clamping device 26.

Arranged on the underside of the horizontal leg 22 of the contact rail 20 is a driver 50, by means of which the carriage 14 is fastened to a toothed belt 52. The latter is stretched out on the rear side of the stand 12, in the direction of movement of the carriage 14, between two toothed belt wheels 54, the lower end of which can be driven by a motor 60 via a toothed gear 58. The driver 50 penetrates through a slot 56 in the stand 12 from the front side to its rear side. By virtue of the rotational movement of the motor 60 in the appropriate direction, the carriage 14 can be adjusted between its uppermost position, shown in FIG. 1, and the end position illustrated in FIG. 2 and moved into the printer. In this case, the inherently rigid arrangement composed of the guide shaft 30, gearwheels 32 and racks 34 ensures that the carriage 14 is guided exactly parallel to itself. Furthermore, it may be inferred from FIGS. 1 and 2 that, in these two positions, the actuating cams 48 are not in contact with the leaf springs 40.

FIGS. 3*a*–3*f* show details of the transport device 10 in side views, the carriage 14 being illustrated in six different positions a to 3*a*–3*f*. The contact rail 20 is in section. The clamping lever 35 is designed as a two-armed lever, the upper lever arm 62 of which is located opposite the vertical leg 24 of the contact rail 20 and the lower lever arm 64 of which is located opposite a lower leg 66 formed onto the contact rail 20. A compression spring 68 is inserted between the lower lever arm 64 and the lower leg 66, thus resulting, for the clamping device 26, in the form of a clamp which is loaded with the force of the compression spring 68 in the closing direction.

Figure 2:
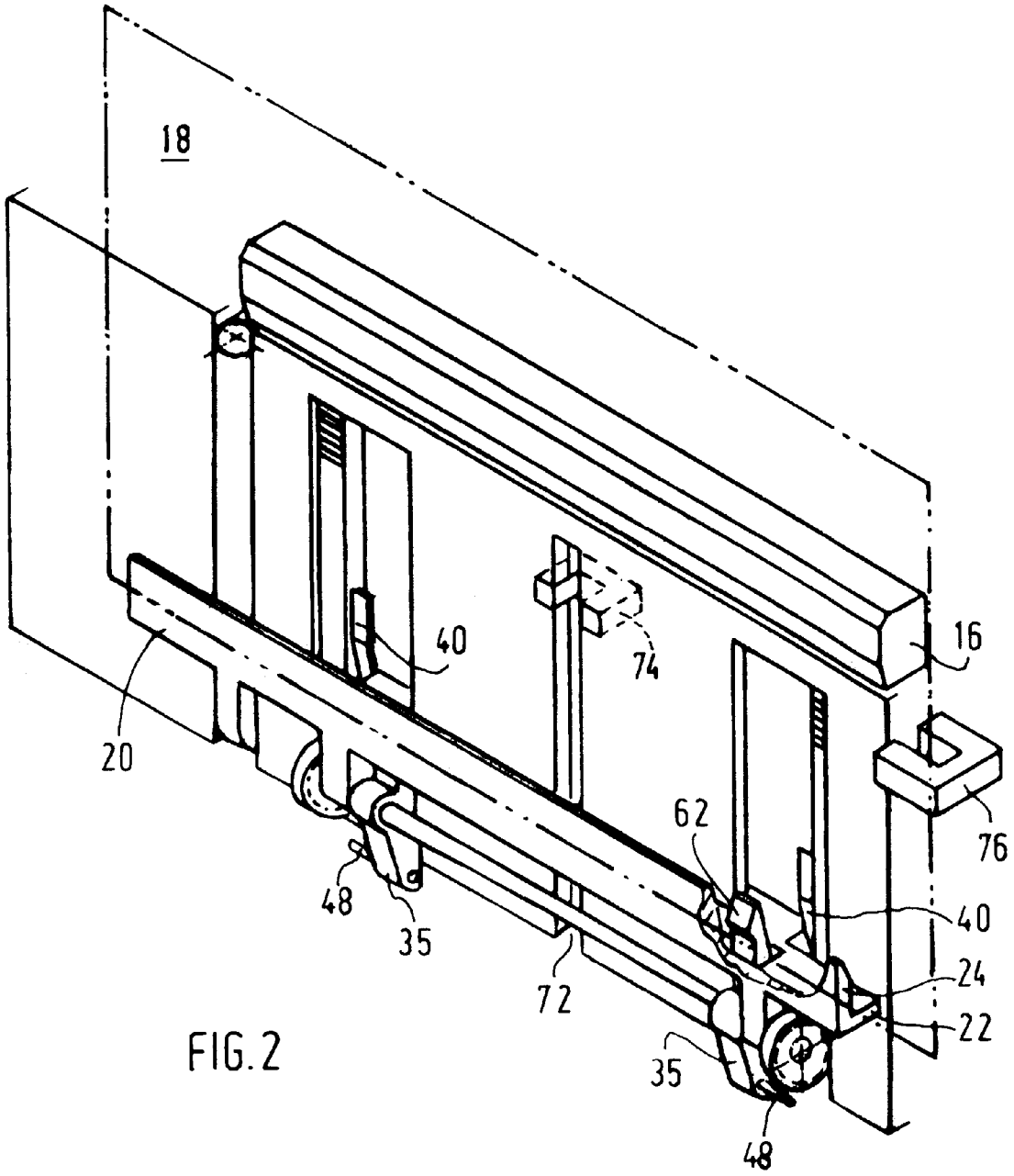

The actuating cam 48 is mounted laterally on the lower leg 64. Furthermore, the contact rail 20 is provided with a switching tab 70 which projects through a second slot 72 (see FIG. 1) in the stand 12 and which co-operates with a first fork-type light barrier 74 arranged on the rear side of the stand. Both this and a second fork-type light barrier 76 (see FIG. 1) signalling the presence of a sheet 18 in the transport device 10 are illustrated in FIG. 2.

The mode of operation of the transport device according to the invention is described below.

FIG. 3*a* shows the starting position of the carriage 14, in which position a sheet 18 can be inserted. This is signalled to a control, not illustrated, by the switching tab 70 interrupting the light beam from the first fork-type light barrier 74. In the starting position, the actuating cam 48 rests against the front side of the upper part 42 of the leaf spring 40, with the result that the clamp-like clamping device 26 is kept open counter to the force of the compression spring 68. When a sheet 18 is then introduced, the latter is placed with its lower edge onto the horizontal leg 22 of the contact rail 20. At the same time, the second fork-type light barrier 76 signals the presence of a sheet 18 to the control.

The current is then passed through the motor 60 in the moveout direction of the carriage 14, until the switching tab 70 unblocks the first fork-type light barrier 74. This position is illustrated in FIG. 3*b* and in FIG. 1. The actuating cam 48 has come free of the leaf spring 40 on the path from the starting position into this uppermost possible position, so that the compression spring 68 can close the clamping device 26. The sheet 18 is then clamped between the upper lever arm 62 of the clamping lever 35 and the vertical leg 24 of the contact rail 20, and at the same time, as before, its lower edge lies on the horizontal leg 22 of the contact rail 20.

FIG. 3*c* illustrates the position in which the lowest possible line of the sheet 18 can be printed. This is indicated symbolically by the nozzle 78 of a matrix printing head being located opposite the pressure beam 16. In this position, the actuating cam 48 comes to rest on the rear side of the upper part 42 of the leaf spring 40.

The further the carriage 14 is moved into the printer, the further the actuating cam 48 slides along on the leaf spring 40, flexing the lower part 44 of the latter from the rearwardly flexed shape into a stretched shape. FIG. 3*d* shows the carriage 14 in a position in which the actuating cam 48 is just still resting against the rear side of the leaf spring. In this position, a line in the middle region of the sheet 18 can be printed.

FIG. 3*e* shows the carriage 14 in the end position in which it is moved as far as possible into the printer and in which the uppermost possible line of the sheet 18 can be printed. The actuating cam 48 has moved down from the leaf spring 40, with the result that the latter was able to jump out of its stretched shape back into the rearwardly flexed shape.

When the direction of rotation of the motor 60 is reversed, then, the carriage 14 moves in the direction of the starting position. FIG. 3*f* shows the carriage 14 in a position in which the actuating cam 48 moves onto the front side of the upper part 42 of the leaf spring 40. Since this part of the leaf spring 40 is rigid, it cannot yield to the pressure of the actuating cam 48, with the result that the clamping device 26 is released. The carriage 14 passes again into the position illustrated in FIG. 3*a*, where the motor 60 is switched off. The sheet 18 can be removed from the transport device 10.

The advantage of the transport device 10 according to the invention is that a sheet 18 can be printed very near to its lower edge, an exact line spacing being maintained, since the carriage 14 always comes from the same direction, even in the case of the lowest line. Unavoidable gear play in the carriage drive is therefore of no consequence.

Although other modifications and changes may be suggested by those skilled in the art, it is the intention of the inventors to embody within the patent warranted hereon all changes and modifications as reasonably and properly come within the scope of their contribution to the art.

We claim:

1. A device for transporting a sheet to be printed along a line direction in a printer having a fixed frame, comprising:

a carriage constructed to receive the sheet and mounted to be displacable on the fixed frame perpendicularly to the line direction between a starting position for inserting and removing the sheet and an end position moved into the printer;

a drive device connected to the carriage so as to displace said carriage;

a releasable clamping device arranged to clamp the sheet, said clamping device is mounted on the carriage;

an actuator that is selectively actuated to release said said releasable clamping device by coming into engagement with the carriage in the starting position of said carriage a contact rail of said carriage with a bearing surface for a lower sheet edge of the sheet, said bearing surface extending perpendicularly to a plane of the sheet;

a clamping lever of said releasable clamping device which is spring-loaded in a clamping direction;

an actuating cam mounted on said clamping lever;

a control bar on the fixed frame on which the actuating cam is guided during displacement of the carriage, in such a way that, in the starting position of the carriage, the actuating cam bears on a predetermined portion of one side of the control bar with a result that the clamping device is kept released, after the starting position has been passed in a direction opposite to an end position the actuating cam passes an upper edge of the control bar with the result that the clamping device is closed, and during movement of the carriage in the direction of the end position the actuating cam slides along on another side of the control bar as far as a lower end of the control bar after passing said end is placed so as to face the one side of the control bar and during the movement of the carriage in the direction of the starting position slides along on said control bar, the clamping device remaining closed until the carriage coming from the end position runs onto the predetermined portion of the control bar.

2. The device as claimed in claim 1, wherein said fixed frame is a plastic injection molding.

3. The device as claimed in claim 1, wherein said clamping lever is a two-armed first lever, said contact rail is a two-armed second lever connected to said two-armed first lever to produce a clamp having lower clamp arms and upper clamp arms, and further comprising:

a compression spring between the lower clamp arms which exerts a compression so that the sheet is clamped between the upper clamp.

4. The device as claimed in claim 3, wherein said contact rail is angle-shaped in such a way that a first leg of the contact rail extending parallel to the sheet plane forms one of the upper clamp arms and a second leg of the contact rail extending perpendicularly to the sheet plane forms a bearing surface for the sheet, and said clamping lever being mounted rotatably on the contact rail.

5. The device as claimed in claim 4, wherein said clamping lever is inherently rigid against flexing, the actuating cam is arranged on the lower lever arm of the clamping lever, and the control bar is a stretched spring of which an upper part of its side edge is connected to the fixed frame and the lower part of which points away from the displacement path of the carriage at an acute angle, said upper part being assigned to said predetermined portion.

6. The device as claimed in claim 5, wherein said control bar is a leaf spring.

7. The device as claimed in claim 5, wherein said control bar is a spring wire.

8. The device as claimed in claim 4, wherein at least one lever arm of said two-armed first lever of the clamping lever has the actuating cam arranged thereon, said at least one lever arm being elastically deformable, and said control bar being inherently rigid against flexing and being connected laterally to said fixed frame.

9. The device as claimed in claim 6, wherein said control bar is a plastic injection molding in one piece with said fixed frame.

* * * * *